United States Patent [19]

Arney et al.

[11] Patent Number: 4,720,625

[45] Date of Patent: Jan. 19, 1988

[54] FUNCTION STRIP ATTACHMENT

[75] Inventors: Michel D. Arney, Lowell; Clifford E. LaCount, Townsend, both of Mass.

[73] Assignee: Wang Laboratories, Inc., Lowell, Mass.

[21] Appl. No.: 18,811

[22] Filed: Feb. 4, 1987

Related U.S. Application Data

[63] Continuation of Ser. No. 794,210, Nov. 1, 1985, abandoned.

[51] Int. Cl.[4] ..... G06C 7/02; G06C 25/00

[52] U.S. Cl. ..... 235/145 R; 29/451; 40/2 R; 49/489; 400/272; 403/298

[58] Field of Search ..... 29/451, 235; 40/2 R; 49/475, 489; 400/493, 472, 476, 485, 495; 403/381, 383, 298; 235/145 R, 145 A

[56] References Cited

U.S. PATENT DOCUMENTS

| | | | |
|---|---|---|---|
| 3,378,958 | 4/1968 | Parks et al. | 49/489 |
| 3,964,594 | 6/1976 | Gabbrielli et al. | 400/493 X |
| 4,100,402 | 7/1978 | Lundstrom | 400/493 X |
| 4,386,482 | 6/1983 | Quinif | 49/489 X |
| 4,510,715 | 4/1985 | Giguere | 49/489 X |
| 4,538,380 | 9/1985 | Calliander | 49/489 X |

*Primary Examiner*—Charlie T. Moon

*Attorney, Agent, or Firm*—Michael H. Shanahan; Gordon E. Nelson

[57] ABSTRACT

Attachment apparatus for attaching a first object to a second object. The first object has a groove with parallel sides; the second object has attached thereto a spline with a flexible blade. When the spline is inserted in the groove, the blade exerts a force against one wall of the groove which forces the spline against the other wall, thereby retaining the spline in the groove. Also disclosed is label attachment apparatus employed generally to removably attach a label to a surface and specifically to removably attach a function key strip to a keyboard. The surface has a groove and the label has means which frictionally engage the groove. A preferred embodiment of the label attachment apparatus employs the groove, spline, and flexible blade as described above.

10 Claims, 4 Drawing Figures

FIRST EMBODIMENT 401

SECOND EMBODIMENT 402

CROSS-SECTION OF FUNCTION STRIPS OF THE PRESENT INVENTION

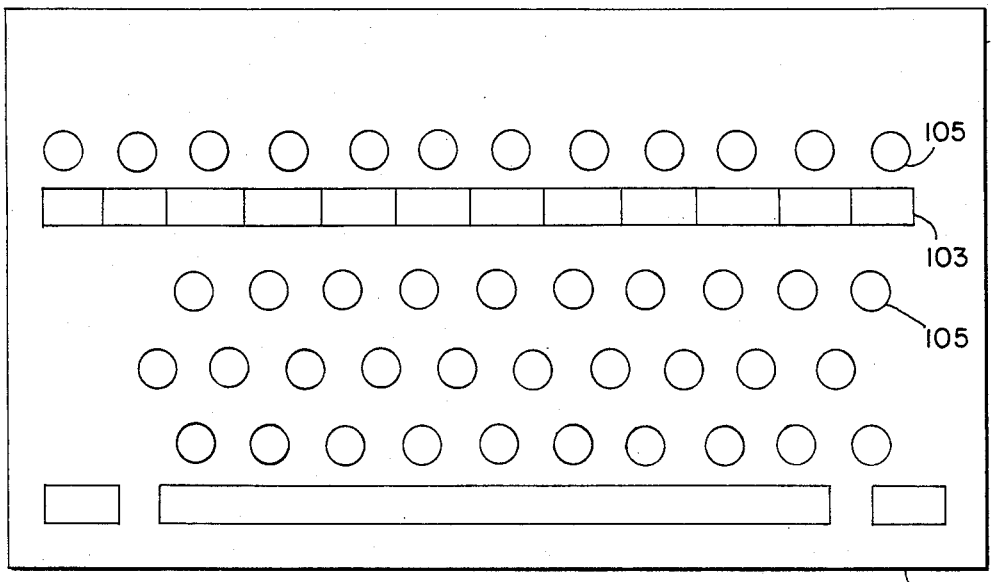
FIG. 1 : KEYBOARD WITH FUNCTION STRIP
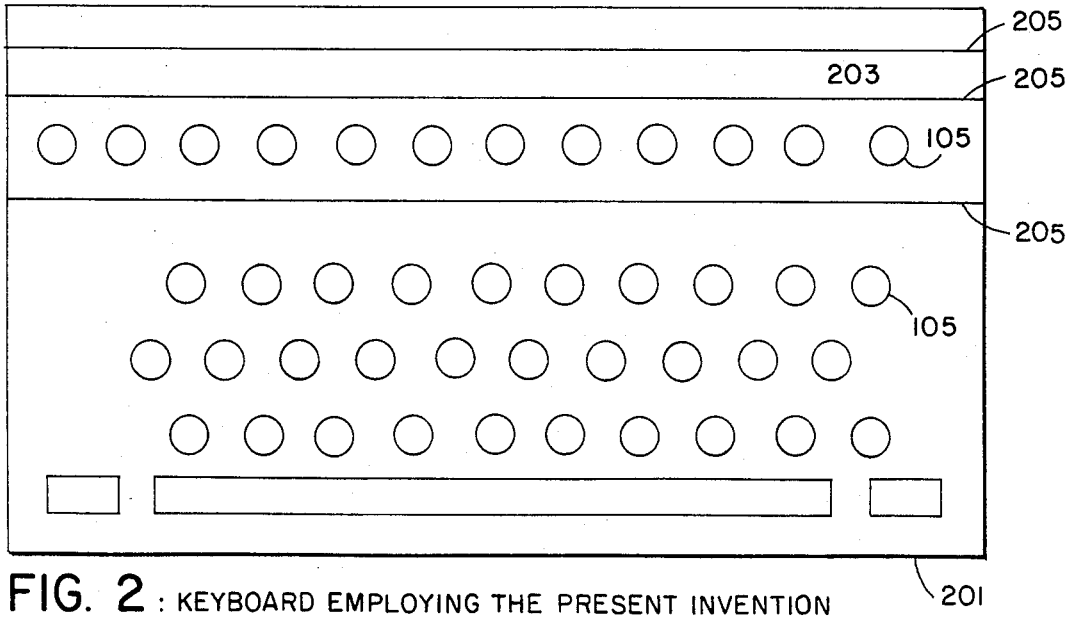
FIG. 2 : KEYBOARD EMPLOYING THE PRESENT INVENTION
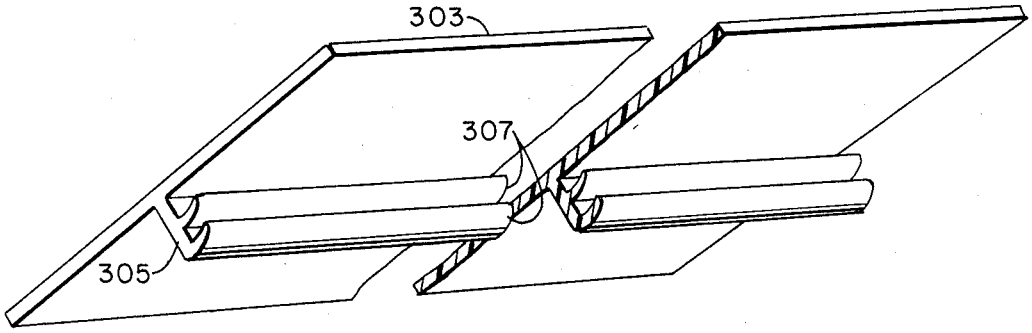
FIG. 3 : VIEW OF FUNCTION STRIP 301 OF THE PRESENT INVENTION

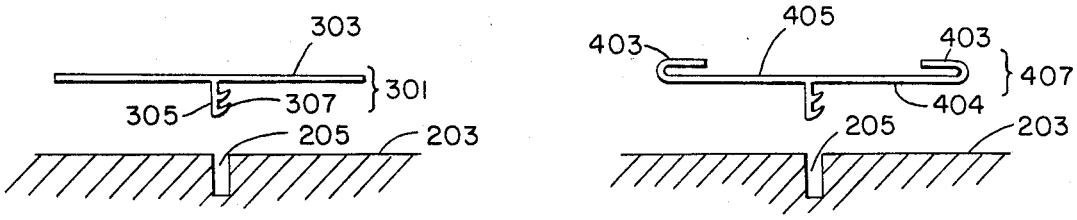
FIRST EMBODIMENT 401
SECOND EMBODIMENT 402
FIG. 4: CROSS-SECTION OF FUNCTION STRIPS OF THE PRESENT INVENTION

FUNCTION STRIP ATTACHMENT

This is a continuation of co-pending application Ser. No. 794,210 filed on Nov. 1, 1985, now abandoned.

BACKGROUND OF THE INVENTION

1. Field of the Invention

The present invention relates generally to apparatus for removably attaching one item to another and more specifically to apparatus for attaching labels to surfaces. One application of the invention is apparatus by means of which function strips may be attached to the keyboards used with typewriters, word processors, computer terminals, and similar devices.

2. Description of the Prior Art: FIG. 1

Originally, keyboards were part of mechanical devices such as typewriters. In such devices, the functions which a given key performed remained unchanged for the life of the device. As the devices with which the keyboards were used became first electrical and then electronic, the relationship between a key and the function it performed became changeable. For example, electric typewriters often have removable type elements. On one occasion, the type element may contain a Latin alphabet and a given keystroke will produce a given Latin letter; on another, it may contain a Greek alphabet and the same keystroke will produce a given Greek letter. When keyboards are used with programmable devices, the relationship between a key and the function it performs may vary from program to program, and in many cases, the user himself may program the key to give it a private meaning. Indeed, programmable keys became so important with computers that keyboards for use in computer systems often contained one or more rows of special function keys above or to the sides of the main alphanumeric keyboard.

As it became possible to change the functions performed by keys, keyboard users and makers developed various methods of indicating what a key meant at a given time. Users taped labels onto keys and makers provided detachable key caps. After one or more rows of programmable function keys became a regular feature of keyboards in computer systems, users began using function strips to identify the functions which the programmable function keys represented during execution of a given program. FIG. 1 shows a keyboard 101 with such a function strip 103. As may be seen from that figure, function strip 103 is simply a strip of labels which indicate the current meaning of a row 105 of keys functioning as programmable function keys.

The first function strips 101 were simply strips of tape which users placed above or below a row of function keys 105; later, system manufacturers and program makers provided users with cardboard templates. The templates were cut out so that they would fit over the row of function keys; when a user executed a program, he put the template for the program over the function keys and could tell what functions the keys had in that program from the template. Finally, the makers of keyboards began incorporating provisions for attaching function strips 103 into their keyboards 101. Among these provisions were channels or brackets above or below function keys 105 into which the user oould slide a function strip which he made for himself or received with a program. Another such provision was buttons on the keyboard and slits in the function strip which permitted the function strip to be "buttoned" to the keyboard.

As keyboard users have begun to routinely use programs having different sets of function keys, the need has increased for function strips which can be securely mounted and are tidy, but which may be rapidly changed. Further, users are now able to shift rapidly back and forth between programs, and cannot be expected to change function strips each time they change programs. Consequently, it is no longer enough to be able to attach a single function strip to the keyboard, and the technique used to attach the function strips must provide for several such strips.

None of the prior art techniques is completely adequate for the needs of present-day keyboard users. Tape function strips are untidy and hard to change. Function strips attached by channels, brackets, or buttons have several disadvantages: first, the function strips are hard to change; second, the channels and buttons remain even if no function strips are being used and detract from the appearance of the keyboard; third, in the case of channels or brackets, the width of the space required for the channel or bracket is greater than the width of the function strip, and thus requires that keyboards be wider than is required for the function strip alone. Template function strips, finally, while easy to change, are untidy and tend to fall off the keyboard; furthermore, only one template function strip can be used at a time with a row of function keys 105. As will be explained in more detail below, the present invention solves the the problems of prior-art function strip attachment techniques by providing a technique which is tidy, provides a secure attachment, takes up little space, permits easy change of function strips, permits more than one function strip, and which does not detract from the appearance of the keyboard when no function strips are being used.

SUMMARY OF THE INVENTION

The invention is apparatus which may generally be used to attach a label to a surface in such a fashion that the label may be easily removed. The surface to which the label is to be attached has a groove and the label itself is on a strip. Joined to the strip is a spline including elastic components. When the spline is pressed into the groove, the elastic components engage the side walls of the groove. The resulting friction holds the spline in the groove and thereby attaches the strip to the surface. Since the attachment is purely frictional, the label can be removed by pulling upward on the strip with enough force to overcome the friction and pull the spline out of the groove. Depending on how the spline is attached to the strip, the label may be flat on the surface or stand up from the surface. The elastic components may include flexible blades which are compressed against the walls of the groove when the spline is inserted in the groove and thereby provide the frictional engagement between the spline and the groove.

When used to attach a function strip to a keyboard, the invention takes the following form: the surface of the keyboard contains a rectilinear groove parallel to the row of keys to which the function strip is to apply and the spline is attached longitudinally to the function strip. The function strip is attached by inserting the spline into the rectilinear groove. Generally, the spline is attached in the region of the center of the function strip and at substantially right angles to it, so that the attached function strip lies on the surface of the keyboard.

As may be seen from the above, the function strip of the invention is tidy and securely held to the keyboard, but may be easily attached and removed. Furthermore, there may be as many function strips attached to the keyboard as there are grooves in the keyboard, and no more space is required on the keyboard for the function strip than the width of the strip itself. Finally, the small grooves required for attachment of the function strip may also function as design elements in the keyboard and thus do not detract from the appearance of the keyboard when no function strips are in use.

The spline, blades, and groove used to attach the function strip to the keyboard may be used generally to attach a first object to a second object. When so used, the first object has a groove with parallel sides and the second object has attached to it a spline with flexible blades. The second object is attached to the first object by inserting the spline in the groove. The blades engage one wall of the groove and force the spline against the other wall, thereby retaining the spline in the groove and attaching the second object to the first.

It is thus an object of the invention to provide improved apparatus for attaching one object to another;

It is another object of the invention to provide an improved technique for attaching a label to a surface;

It is a further object of the invention to provide an improved technique for attaching a function strip to a keyboard;

It is an additional object of the invention to provide a technique by which function strips may be easily attached to and removed from a keyboard;

It is a still further object of the invention to provide a technique by which more than one removable function strip may be simultaneously attached to a keyboard;

It is still another object of the invention to provide a technique permitting easy attachment and removal in which no more space is required than the width of the function strip.

Other objects and advantages of the present invention will be understood by those of ordinary skill in the art after referring to the detailed description of a preferred embodiment and the drawings, wherein:

BRIEF DESCRIPTION OF THE DRAWINGS

FIG. 1 is a conceptual diagram of a keyboard with a function strip.

FIG. 2 is a conceptual diagram of a keyboard employing the present invention.

FIG. 3 is an enlarged isometric projection of the function strip of the present invention.

FIG. 4 is cross sections of two preferred embodiments of the function strip of the present invention.

Reference numbers employed in the drawings have three digits. The most significant digit is the number of the drawing in which the item referred to by the reference number first appears. Thus, an item with the reference number 201 appears first in FIG. 2.

DESCRIPTION OF A PREFERRED EMBODIMENT: FIGS. 2-4

FIG. 2 is a top view of a keyboard 201 for use with a computer terminal, a personal computer, a word processing system, or the like. Keyboard 201 is a standard keyboard of a type well-known in the art, exept that surface 203 of the keyboard has been provided with three straight grooves 205 parallel to rows of function keys 105. A function strip of the present invention may be attached to each of the grooves 205, and the top two grooves 205 are far enough apart so that function strips may be attached to them simultaneously. Consequently, keyboard 201 may carry three different function strips of the present invention at any given time. Of course, in other keyboards 201, the number of rows 105 of function keys and the number of grooves 205 may vary. In the preferred embodiment, the sides of each groove 205 are parallel planes.

FIG. 3 is an enlarged isometric projection of an embodiment of function strip 301 of the present invention. Function strip 301 includes strip 303, whose upper surface carries the labels for the keys, spline 305, which runs longitudinally along strip 303 at approximately right angles to it, and blades 307, which run longitudinally along spline 305. Blades 307 are flexible but resist deformation, and consequently function as springs. Spline 305 is no broader than groove 205 is deep and spline 305 with flexible blades 307 is slightly wider than groove 205.

When a user of keyboard 201 places function strip 301 over a groove 201 in such a fashion that spline 305 engages groove 205 and presses down, spline 305 is inserted into groove 205 and blades 307 are bent as much as required to make spline 305 and blades 307 fit into groove 205. Since blades 307 are flexible but resist deformation, they work against one wall of groove 205 and force spline 305 against the other wall with sufficient force to retain spline 305 in groove 205 even though groove 205 has parallel sides. Since spline 305 is at substantially right angles to strip 303, strip 303 is thereby held flat on top of surface 203. To remove function strip 301 from groove 205, the user of terminal 201 simply pulls up on strip 303. When sufficient force is applied, blades 307 again deform and spline 305 comes out of groove 205, freeing function strip 301 from terminal 201. In a preferred embodiment, function strip 301 is made of flexible plastic and the user can press a portion of spline 305 into groove 205 and then continue pressing longitudinally along strip 303 until the entire length of spline 305 has been inserted in groove 205.

The technique used in the preferred embodiment to attach function strip 301 to keyboard 201 may be generally used to attach a first object to a second object. All that is required is that the first object have a groove with parallel sides like groove 205 and that the second object have a spline with flexible blades attached thereto like spline 305 and blades 307 of the preferred embodiment. The second object is then attached to the first object by pressing the spline into the groove. The flexible blades engage one side of the groove, force the spline against the other side of the groove, and thereby retain the spline in the groove.

FIG. 4 shows cross sections of two preferred embodiments of function strip 301, of surface 203, and of groove 205. First embodiment 401 is the same as the one illustrated in FIG. 3. In this embodiment, the information carried by the function strip is printed or written directly on the top surface of strip 303. In second embodiment 402, groove 205, spline 305, and blades 307 of function strip 407 are the same as in first embodiment 401, but the information carried by function strip 407 is not printed or written directly on the top surface of strip 404. Instead, strip 404 is adapted to accept plastic or paper strip 405, upon which is written or printed the information carried by function strip 407. In a preferred embodiment, strip 405 is held onto strip 404 by tabs 403.

Materials and dimensions in inches used in one implementation of second embodiment 402 are the following: groove 205 is 0.035 wide and 0.087 deep, with parallel sides and a rounded bottom. Function strip 407 is extruded from clear cellulose proprionate. The material in the extruded strip has a thickness of 0.012 to 0.015. Strip 404 is 0.67 wide and each tab 403 is 0.10 wide. Spline 305 is 0.075 deep and blades 307 and spline 305 together are 0.038 wide. Blades 307 form an angle of 60 degrees with spline 305.

The foregoing Description of the Preferred Embodiment has disclosed how one skilled in the art may construct and use novel means for attaching one object to another, employ those means generally to attach a label to a surface, and employ them more specifically to provide a function strip superior to those heretofore available and has disclosed preferred embodiments of the attachment means and function strip. The invention may, however, be embodied in specific forms other than the ones disclosed herein without departing from the spirit or essential characteristics thereof. For example, in the function strip disclosed herein, other means than the spline and blades may be used to engage the groove and the groove need not have parallel sides. Further, the function strip may be made of other materials, more than one spline may be employed, and the splines may run transversely instead of longitudinally. Finally, embodiments of the function strip may be made employing grooves, splines, and blades having shapes or dimensions other than those specified above. Thus, the preferred embodiment described herein is to be considered in all respects as illustrative and not restrictive, the scope of the invention being indicated by the appended claims rather than by the foregoing description, and all changes which come within the meaning and range of equivalency of the claims are intended to be embraced therein.

What is claimed is:

1. Means for exchangeably labelling a row of keys in a keyboard with an optional label comprising:

(1) label bearing means for bearing the label;

(2) a narrow groove in a surface of the keyboard adjacent to the row of keys, the width of the groove being substantially less than the width of the label bearing means; and (3) groove engaging means attached to the label bearing means so as to project below the label bearing means on the side opposite the label for engaging the groove when inserted therein and disengaging from the groove without damage to the groove engaging means or the groove when the label bearing means is pulled away from the groove with sufficient force to overcome the engagement, whereby the label is easily and repeatedly installable and removable and the groove serves as an aesthetic design element in the keyboard when no label is installed.

2. In the labelling means of claim 1 and wherein:
the width of the groove is such that the groove appears as a styling line in the surface.

3. In the labelling means of claim 2 and wherein:
the groove is less than 0.05 inch wide.

4. In the labelling means of claim 2 and wherein:
the groove is rectilinear.

5. In the labelling means of claim 1 and wherein:
the groove is rectilinear and runs in substantially the same direction as the row of keys; and
the groove engaging means is attached longitudinally to the label bearing means on the side opposite the label.

6. In the labelling means of claim 5 and wherein:
the groove is less than 0.05 inch wide.

7. In the labelling means of claim 5 and wherein:
the groove engaging means extends the entire length of the label bearing means.

8. In the labelling means of claim 7 and wherein:
the groove engaging means and the label bearing means are formed as a single piece by means of extrusion.

9. In the labelling means of claim 8 and wherein:
the groove engaging means is a spline attached at right angles to the label bearing means and a flexible blade attached longitudinally to the spline.

10. In the labelling means of claim 1 and wherein:
the label bearing means covers that portion of the groove engaged by the groove engaging means.

* * * * *